US005722798A

United States Patent [19]

Gregory

[11] Patent Number: 5,722,798

[45] Date of Patent: Mar. 3, 1998

[54] SYSTEM FOR RAISING AND SUPPORTING A BUILDING

[75] Inventor: Steven D. Gregory, Richardson, Tex.

[73] Assignee: Gregory Enterprises, Ada, Okla.

[21] Appl. No.: 602,406

[22] Filed: Feb. 16, 1996

[51] Int. Cl.[6] ..... B66F 3/00; E02D 5/00; E02D 5/02

[52] U.S. Cl. ..... 405/230; 254/133 R; 405/231

[58] Field of Search ..... 405/229, 230, 405/231; 254/133 R

[56] References Cited

U.S. PATENT DOCUMENTS

| | | | |
|---|---|---|---|
| 3,796,055 | 3/1974 | Mahony | 405/230 |
| 3,902,326 | 9/1975 | Langenbach, Jr. | 405/230 |
| 4,070,867 | 1/1978 | Cassidy | 405/231 |
| 4,634,319 | 1/1987 | May | 405/230 |
| 4,673,315 | 6/1987 | Shaw et al. | 405/230 |
| 4,695,203 | 9/1987 | Gregory | 405/230 |
| 4,765,777 | 8/1988 | Gregory | 405/230 |
| 4,911,580 | 3/1990 | Gregory et al. | 405/230 |
| 4,925,345 | 5/1990 | McCown, Jr. et al. | 405/230 X |

FOREIGN PATENT DOCUMENTS 1 418 164 12/1975 United Kingdom .

*Primary Examiner*—Tamara L. Graysay
*Assistant Examiner*—Tara L. Mayo
*Attorney, Agent, or Firm*—Haynes and Boone, L.L.P.

[57] ABSTRACT

A system for raising and supporting the foundation or slab of a building, in which a mounting assembly is bolted to the foundation or slab and includes a pair of support sleeves which receive a piling and which are connected to the foundation or slab. A clamping assembly engages the piling, and a hydraulic ram is connected between the clamping assembly and the mounting assembly in the expanded position of the ram so that when the ram is retracted, the piling means is driven into the ground until it encounters a predetermined resistance. The ram is further actuated after the predetermined resistance is encountered to raise the mounting assembly and the foundation or slab a predetermined distance after which the mounting assembly and the foundation or slab are secured to the piling.

75 Claims, 3 Drawing Sheets

SYSTEM FOR RAISING AND SUPPORTING A BUILDING

BACKGROUND OF THE INVENTION

This invention relates to a system for raising and supporting a building and, more particularly, to such a system in which the foundation or concrete slab of a building is raised and supported by a plurality of pilings.

Houses and other buildings are often erected on foundations or concrete slabs which are not in direct contact with load supporting underground strata, such as bedrock, or the like. If not initially constructed properly, or if soil conditions change, the foundation footing may settle, causing the foundation or slab to sag and/or crack. Unless the building is supported, or shored, continued settling may result in major structural damage or collapse of the building.

There have been several suggestions in the prior art for raising and supporting the foundation or slab of a building of this type. For example, according to one technique, beam members, or the like, are placed underneath the foundation and lifted to raise the foundation. However, this requires significant excavation of the ground area around the foundation which is very time consuming and labor intensive. Also, according to some of the latter techniques, the foundation or slab is lifted, or jacked up, and pilings are inserted underneath to support same. However, the pilings are often not directly supported on the bedrock, resulting in continued settling after the pilings are in place. Further, in many instances, the pilings are visible above the basement floor.

In still other prior art techniques utilizing pilings, a single hydraulically actuated system is used for each piling, requiring the use of a relatively high hydraulic pressure system which is expensive and cumbersome to use. Also, in these systems it is difficult to apply a symmetrical load along the axes of the pilings which is essential to avoid undue stresses and strains on the pilings.

Therefore, what is needed is a foundation raising and supporting system in which the pilings are supported on bedrock and a symmetrical, stabilized, coaxially-directed load is applied to the pilings requiring minimal excavation and relatively low hydraulic lifting pressure.

SUMMARY OF THE INVENTION

The present invention, therefore, provides a system for supporting and raising a foundation or slab in which several pilings are attached to a side wall of the foundation and a symmetrical, coaxially-directed load is applied to each of the pilings of each assembly during the raising process to drive the pilings to bedrock. To this end, a lifting assembly is bolted to the side walls of the foundation and a drive unit engages the upper portion of the pilings. A hydraulic ram unit is connected between the lifting assembly and the drive unit and is retracted to drive the pilings into the ground. A guide sleeve stabilizes and directs the loads on the pilings in a coaxial, symmetrical relationship and, after resistance is encountered, the foundation is raised and secured in the raised position.

As a result, the system and method of the present invention requires minimum excavation of the ground surrounding the foundation. Also, the pilings assemblies are supported on load-bearing bedrock and a symmetrical, stabilized coaxially-directed load is applied to each piling. Further, the pilings are easily attached relative to the raised foundation with a minimum of time and effort.

DESCRIPTION OF THE PREFERRED EMBODIMENT

Figure 1:
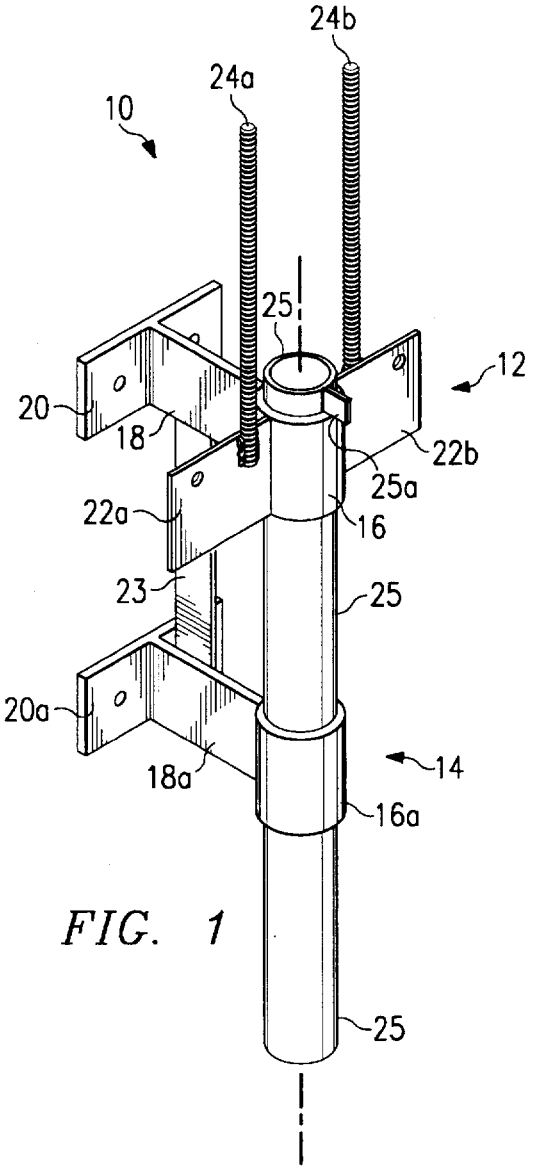
FIGS. 1–3 are perspective views depicting the system of the present invention in various stages of operation.

Referring specifically to FIG. 1 of the drawings, the reference numeral 10 refers, in general, to the system of the present invention which includes an upper mounting assembly 12 and a lower mounting assembly 14. The upper mounting assembly 12 includes a support sleeve 16 having a plate, or arm, 18 extending perpendicular thereto. A mounting plate 20 extends perpendicular to the plate 18 and is adapted to be secured to the side wall of a foundation by bolts, or the like, extending through openings provided in the plate, as will be described. The plate 18 is connected to the support sleeve 16 and to the plate 20 in any conventional manner, such as by welding.

A pair of attachment plates **22*a* and 22*b* are connected to diametrically opposed outer surfaces of the support sleeve 16 and each has a pair of openings extending therethrough for connection to a hydraulic ram unit, as will be described. A pair of threaded rods 24*a* and 24*b* are connected to the plates 22*a* and 22*b*, respectively, and extend upwardly therefrom, also for reasons to be described. The plates 22*a* and 22*b* are connected to the support sleeve 16, and the rods 24*a* and 24*b* are connected to the plates 22*a* and 22*b***, respectively, in any conventional manner, such as by welding.

The lower mounting assembly 14 includes a support sleeve **16*a*, a plate 18*a* and a mounting plate 20*a*, all identical to the corresponding components of the upper mounting assembly 12. The support sleeve 16*a* is axially spaced from, and in a coaxial relationship with, the support sleeve 16 of the upper mounting assembly, and a plate 23 extends from the plate 18 of the upper mounting assembly 12 to the plate 18*a* of the lower mounting assembly 14** to connect the assemblies.

A guide sleeve 25 extends through the aligned support sleeves 16 and **16*a*, with its upper end portion extending upwardly from the upper end of the support sleeve 16 as viewed in FIG. 1, and its lower end extending downwardly from the support sleeve 16*a*. A lip 25*a* is attached to the upper end portion of the guide sleeve 25 and engages the upper end of the support sleeve 16 to maintain the guide sleeve 25** in the position shown.

Figure 2:
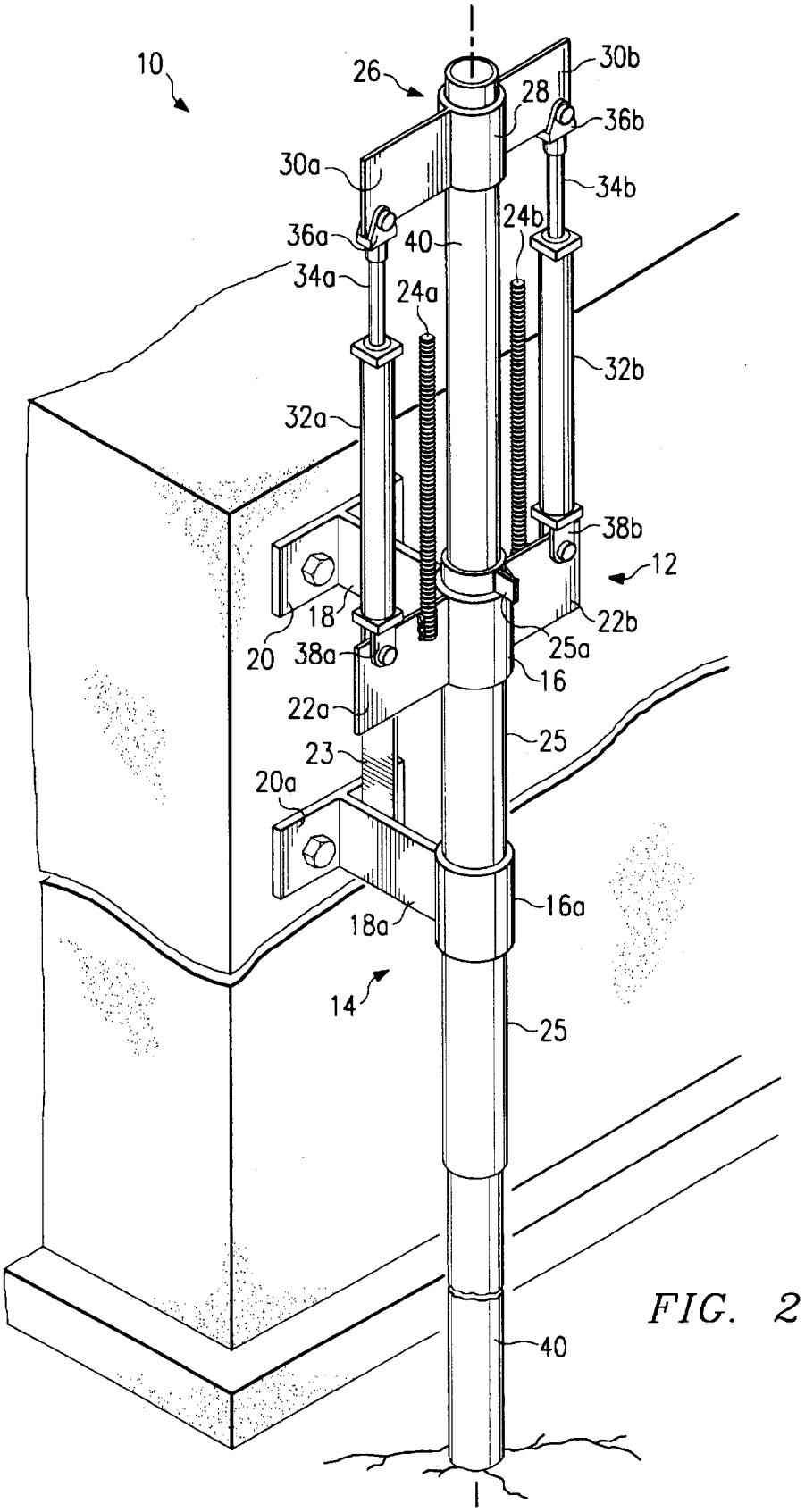

FIG. 2 depicts the apparatus of FIG. 1 mounted to a side wall of a foundation F along with a clamping assembly 26 which extends above the upper mounting assembly 12 and includes a gripping sleeve 28. Although not clear from the drawings, it is understood that the sleeve 28 is in the form of a conventional "slip bowl" for grabbing or clamping over a pipe, or piling and, as such, includes three inner arcuate inserts (not shown) which are tapered in a vertical direction so that they will grab, or clamp, a piling segment of a predetermined diameter during downward movement, and slide over the segment during upward movement, in a conventional manner. A pair of plates **30*a* and 30*b* are connected to, and extend from, diametrically opposite portions of the sleeve 28 and each has an opening extending there through. This clamping assembly 26** is disclosed in more detail in applicant's U.S. Pat. No. 4,765,777, the disclosure of which is hereby incorporated by reference.

A pair of drive units, in the form of hydraulic ram units **32*a* and 32*b*, are adapted for installation between the plate 30*a* of the clamping assembly 26 and the plate 22*a* of the upper mounting assembly 12; and between the plate 30*b* of the clamping assembly and the plate 22b of the upper mounting assembly 12. The ram units 32a and 32b include a pair of arms 34a and 34b, respectively, which are connected to pistons (not shown) which reciprocate in the ram units in response to actuation of the units, in a conventional manner. This reciprocal movement of the pistons causes corresponding movement of the arms 34a and 34b** between the extended position shown in FIG. 2 and a retracted position to be described.

The ram units 32a and 32b include a pair of devises 36a and 36b respectively, which are connected to the respective ends of the arms 34a and 34b. The devises 36a and 36b extend over the plates 30a and 30b, respectively and are connected to the latter plates by a pair of bolts. In a similar manner, a pair of devises 38a and 38b are connected to the lower ends of the ram units 32a and 32b, respectively, extend over the plates 22a and 22b, and are connected to the latter plates by a pair of bolts.

The inner diameter of the sleeve 28 of the clamping assembly 26 is sized to receive a piling, shown in general by the reference numeral 40, in a relative close fit, but sufficient to permit slidable movement of the piling relative to the sleeve. It is understood that the piling 40 consists of a plurality of pipe segments connected together in a conventional manner.

Due to the tapered configuration of the above-described arcuate inserts, the clamping assembly 26 can be manually lifted upwardly on the piling 40 without encountering substantial resistance. When the hydraulic ram units 32a and 32b are then retracted, the clamping assembly 26 moves downwardly over the piling 40 and the inserts grab, or clamp, the outer surface of the piling and force it downwardly, as will be described in further detail later.

To install the system 10, the area around the foundation F to be lifted is initially excavated as shown in FIG. 2, the system 10 is placed in the excavated area, and the mounting plates 20 and 20a are bolted to the side walls of the foundation F. Although only one system 10 will be described it is understood that, in actual practice, several additional systems will be spaced around the foundation which are identical to, and operate simultaneously with, the system 10.

The sleeve 25 is inserted through the aligned support sleeves 16 and 16a and driven into the ground until the lip 25a engages the upper end of the support sleeve 16. The sleeve 25 can be driven manually or by use of the hydraulic ram units 32a and 32b in the manner described herein.

A section of the piling 40 is then placed in the sleeve 25 and the clamping assembly 26 is placed over the upper portion of the piling. The hydraulic ram units 32a and 32b, in their extended positions shown in FIG. 2, are then installed between the plates 22a and 30a and between the plates 22b and 30b.

The ram units 32a and 32b are then actuated simultaneously to cause a retracting motion of their corresponding pistons, and therefore the arms 34a and 34b, to force the clamping assembly 26 downwardly. As a result, the sleeve 28 grabs the piling 40 and forces it downwardly into the ground for a predetermined distance. The ram units 32a and 32b are then simultaneously actuated back to their expanded condition, moving the clamping assembly 26 upwardly to an upper portion of the piling 40, and the sequence is repeated. During this sequential driving of the piling 40 into the ground, additional pipe segments may be added to the piling as needed.

It is understood that a shim (not shown) can be inserted between the side wall of the foundation F and the mounting plates 20 and/or 20a as needed to stabilize and align the system during the above operation.

Figure 3:
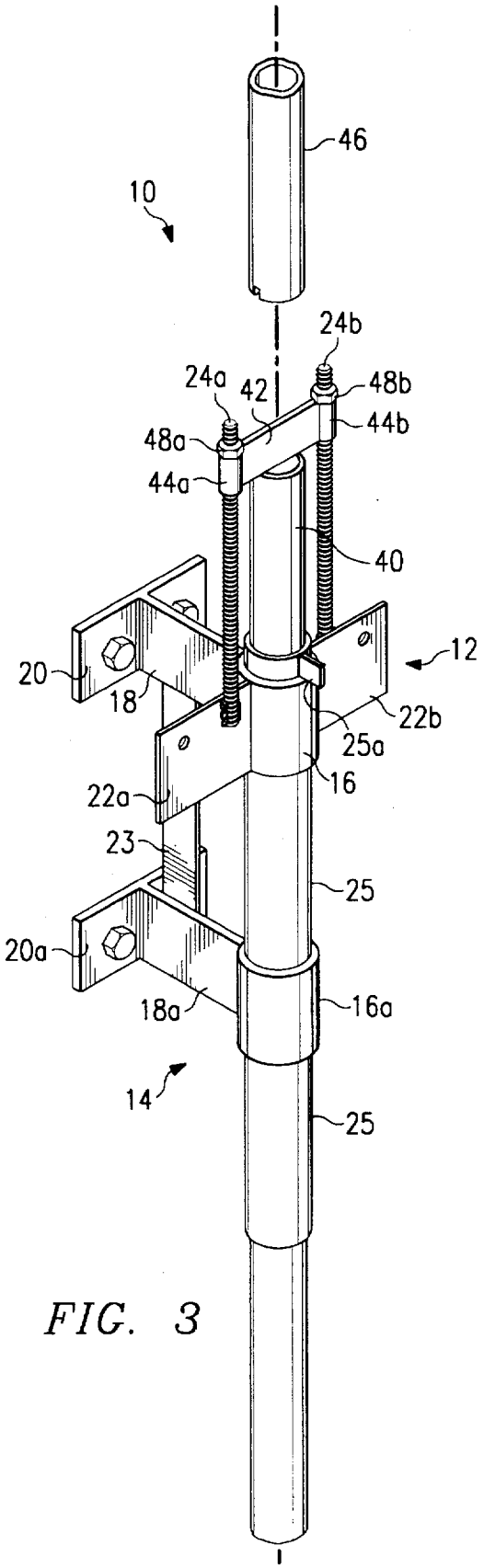
Figure 4:
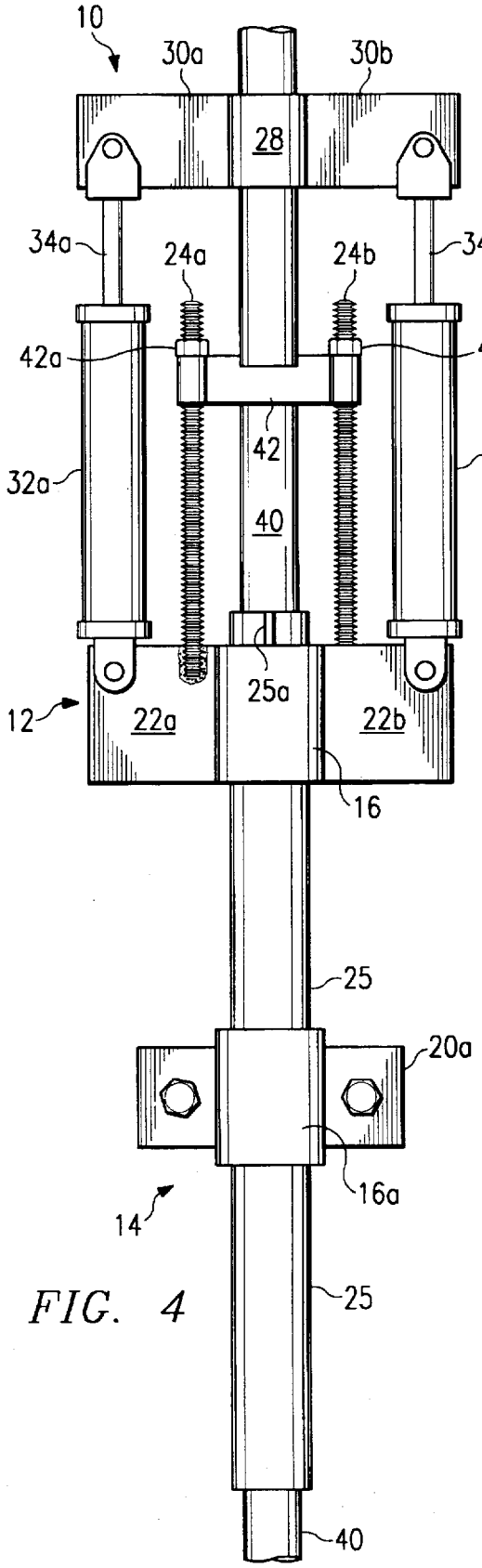
FIGS. 4 and 5 are front elevational views of the system of FIGS. 1–3 showing additional stages of operation.

The above procedure is repeated until the lower end portion of the piling 40 encounters resistance in the ground, which is usually in the form of bedrock or the like, in which case the aforementioned driving movement is terminated and the the procedure depicted in FIGS. 3 and 4 is initiated. More particularly, the upper segment of the piling 40 is cut off so that a few inches extend above the upper end of the sleeve 25. A drive plate 42, having two sleeves 44a and 44b at its ends, is positioned over the upper end of the piling 40 with the sleeves 44a and 44b extending over the rods 24a and 24b, respectively. A drive pipe segment 46 is then placed over the plate 42, with notches in the former extending over the upper edge of the latter.

As shown in FIG. 4, the clamping assembly 26 and the hydraulic ram units 32a and 32b are installed in the manner described in connection with FIG. 2 with the sleeve 28 extending over the pipe segment 46. The arms 34a and 34b are expanded to the extent needed for the sleeve 28 to grasp the upper end portion of the pipe segment 46. The ram units 32a and 32B are then retracted to exert a vertical force against the piling 40 and therefore the plate 42 and the pipe segment 46. Since the piling 40 can no longer be driven downwardly due to the resistance provided by the bedrock, the foundation F will be lifted the desired amount causing the upper mounting assembly 12 and the lower mounting assembly 14 to move upwardly relative to the piling 40, the plate 42, and the pipe segment 46 to the position shown in FIG. 5. Thus, the plate 42 is spaced from its original position on the rods 24a and 24b a distance corresponding to the distance of the lift of the foundation F.

Figure 5:
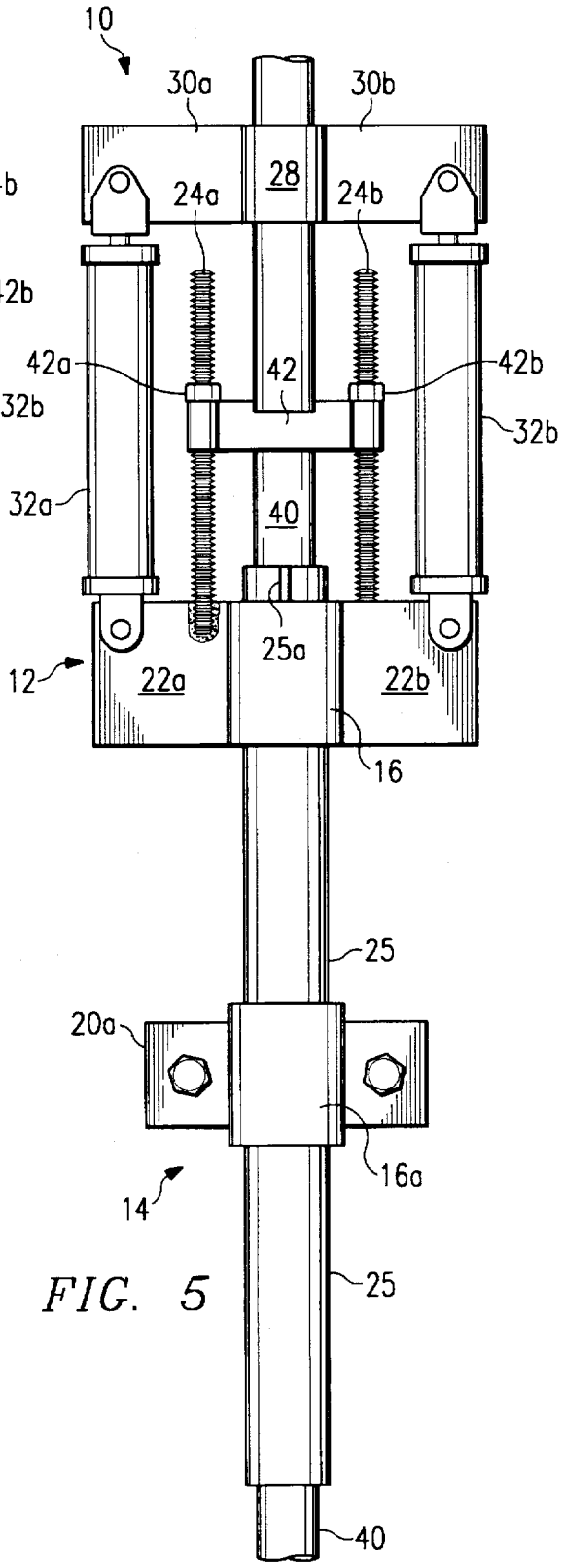

A pair of nuts 48a and 48b are then advanced downwardly over the rods 24a and 24b, respectively until they engage the plate 42 to secure the system 10 in the position of FIG. 5. The hydraulic ram units 32a and 32b along with the clamping assembly 26 and the pipe segment 46 are then removed, and the excavated area around the foundation F and the system 10 is filed with dirt.

As stated above, although only one system 10 is shown in the drawing it is understood that, in actual practice, several systems will be used at once at different locations along the foundation F depending on the extent of the damage. In this context, after all of the pilings 40 associated with the respective systems 10 have been driven into the ground until they encounter resistance, the ram units 32a and 32b associated with the pilings are simultaneously actuated again in the manner described in connection with FIGS. 4 and 5 to uniformly raise the foundation F, and therefore the house, a predetermined distance.

It is apparent from the foregoing that several advantages result from the system of the present invention. For example, minimum excavation of the ground surrounding the foundation F is required. Also, the pilings 40 are supported on load-bearing bedrock and the support sleeves 16a and 16b and the guide sleeve 18 enable a symmetrical, stabilized, coaxially-directed load to be applied to each piling through a moment arm defined by the plates 18 and 18a that provides a significant mechanical advantage. Further, the pilings 40 are easily attached relative to the raised foundation F with a minimum of time and effort.

Further, the system of the present invention eliminates the need for high pressure ram devices, yet permits all of the pilings associated with the particular foundation to be raised at once. Still further, the system of the present invention can be quickly and easily attached to the foundation after the lift, by simply threading the nuts over the two threaded rods.

It is understood that, although the above example was described in connection with the foundation of a building, the system of the present invention can also be used in an identical manner to raise a concrete slab extending underneath the entire area of a building or a house. In the case of a concrete slab, the system 10 would be mounted on an outer wall of the slab.

It is understood that several modifications of the system of the present invention can be made within the scope of the invention. For example, the clamping assembly 26 can be replaced with a block, or driving member that engages the upper end of the piling 40 and, when forced downwardly by the ram units 32*a* and 32*b*, drives the assembly into the ground. Also, an external drive system can be provided to drive the sleeve 25 and then the piling 40 into the ground until a predetermined resistance is encountered, after which the ram units 32*a* and 32*b* can be installed and activated to raise the foundation or slab in the manner described above.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention therein.

What is claimed is:

1. A system for raising and supporting the foundation or slab of a building; said system comprising a support sleeve extending in a spaced relation which receives a piling; a mounting unit for mounting the support sleeve to the foundation or slab; the mounting unit comprising a mounting arm extending from one of the support sleeves, and at least one mounting plate connected to the mounting arm and adapted to be bolted to the foundation or slab; a clamping assembly for engaging the upper portion of the piling; a ram assembly connected between the clamping assembly and the support sleeve for initially applying a load to the piling to drive the piling into the ground until the piling encounters a predetermined resistance, and then applying an additional load to the piling to raise the support sleeve and the foundation or slab a predetermined distance relative to the piling; and means for securing the support sleeve in the raised position relative to the piling to secure the foundation in its raised position.

2. The system of claim 1 wherein the piling has an upper portion extending above the support sleeve and a lower portion extending below the support sleeve and into the ground.

3. The system of claim 1 further comprising a guide sleeve having a lower portion extending into the ground and an upper portion extending through the support sleeves between the piling and the support sleeves.

4. The system of claim 1 wherein the ram assembly is normally in an expanded position and retracts to drive the piling.

5. The system of claim 1 wherein the ram assembly comprises two ram units extending on opposite sides of the piling.

6. The system of claim 5 further comprising two attachment plates extending on opposite sides of the support sleeve for respectively receiving the ram units.

7. The system of claim 5 wherein the clamping assembly comprises a clamping member extending around the upper portion of the piling, and two plates extending on opposite sides of the clamping member for respectively receiving the ram units.

8. The system of claim 7 wherein the clamping member is adapted to clamp the piling upon downward movement relative thereto and to disengage the piling upon upward movement relative thereto.

9. The system of claim 1 further comprising at least one rod extending upwardly from the support sleeve and a plate slidably mounted relative to the at least one rod and connected to the piling for movement therewith.

10. The system of claim 9 wherein there are two rods extending to each side of the piling, and wherein the securing means comprises a pair of nuts in threaded engagement with the rods.

11. The system of claim 9 wherein the mounting unit further comprises at least one plate slidably mounted relative to the at least one rod and connected to the piling for movement therewith.

12. The system of claim 11 wherein the piling comprises a plurality of pipe segments and wherein the at least one plate extends between two adjacent segments.

13. A system for raising and supporting the foundation or slab of a building, said system comprising two spaced support sleeves which receive a piling, two mounting units for respectively mounting the support sleeves to the foundation or slab, a clamping assembly for engaging the upper portion of the piling, a ram assembly connected between the clamping assembly and one of the support sleeves for initially applying a load to the piling to drive the piling into the ground until the piling encounters a predetermined resistance, and then applying an additional load to the piling to raise the one support sleeve and the foundation or slab a predetermined distance relative to the piling, and means for securing the one support sleeve in the raised position relative to the piling to secure the foundation in its raised position.

14. The system of claim 13 further comprising an additional mounting unit for mounting the additional support sleeve to the foundation or slab, the mounting unit comprising a mounting arm connected to the additional support sleeve and a mounting plate connected to the mounting arm and adapted to be bolted to the foundation or slab.

15. A system for raising and supporting the foundation or slab of a building, said system comprising two mounting assemblies disposed in a spaced relationship, each mounting assembly comprising a support sleeve and a mounting unit for mounting the support sleeve to the foundation or slab; a guide sleeve extending through both of the mounting assemblies; a piling extending through and supported by the guide sleeve; and a drive unit for engaging and driving the piling into the ground.

16. The system of claim 15 further comprising a clamping assembly engaging the upper portion of the piling, the drive unit comprising a ram assembly connected between the clamping assembly and the mounting assemblies for initially applying a load to the mounting assemblies to drive the piling into the ground until the piling encounters a predetermined resistance, and then applying an additional load to the piling to raise the mounting assemblies and the foundation or slab a predetermined distance relative to the piling, and means for securing the support sleeve in the raised portion relative to the piling to secure the foundation in its raised position.

17. The system of claim 16 wherein the drive unit is in the form of a hydraulic ram assembly normally in an expanded position and retracts to drive the piling.

18. The system of claim 17 wherein the ram assembly comprises two ram units extending on opposite sides of the piling.

19. The system of claim 18 further comprising two attachment plates extending on opposite sides of one of the support sleeves for respectively receiving the ram units.

20. The system of claim 18 wherein the clamping assembly comprises a clamping member extending around the upper portion of the piling, and two plates extending on opposite sides of the clamping member for respectively receiving the ram units.

21. The system of claim 20 wherein the clamping member is adapted to clamp the piling upon downward movement relative thereto and to disengage the piling upon upward movement relative thereto.

22. The system of claim 16 further comprising at least one rod extending upwardly from the upper support sleeve and a plate slidably mounted relative to the rod and connected to the piling for movement therewith.

23. The system of claim 22 wherein there are two rods extending to each side of the piling, and wherein the securing means comprises a pair of nuts in threaded engagement with the rods.

24. The system of claim 22 wherein the piling comprises a plurality of pipe segments and wherein the plate extends between two adjacent segments.

25. The system of claim 15 wherein the support sleeves are disposed in a vertically spaced relationship and wherein the piling has an upper portion extending above the upper support sleeve and a lower portion extending below the lower support sleeve and into the ground.

26. The system of claim 15 wherein each mounting unit comprises a mounting arm connected to a corresponding support sleeve and a mounting plate connected to a corresponding mounting arm and adapted to be bolted to the foundation or slab.

27. The system of claim 15 further comprising a guide sleeve having a lower portion extending into the ground and an upper portion extending through the support sleeves between the piling and the support sleeves.

28. A system for raising and supporting the foundation or slab of a building, said system comprising a support sleeve which receives a piling, a mounting arm extending from the support sleeve, at least one mounting plate connected to the mounting arm and adapted to be bolted to the foundation or slab to mount the support sleeve to the foundation or slab, a clamping assembly for engaging the upper portion of the piling, a ram assembly connected between the clamping assembly and the support sleeve for initially applying a load to the piling to drive the piling into the ground until the piling encounters a predetermined resistance, and then applying an additional load to the piling to raise the support sleeve and the foundation or slab a predetermined distance relative to the piling, and means for securing the support sleeve in the raised position relative to the piling to secure the foundation in its raised position.

29. The system of claim 28 wherein the piling has an upper portion extending above the support sleeve and a lower portion extending below the support sleeve and into the ground.

30. The system of claim 29 further comprising a guide sleeve having a lower portion extending into the ground and an upper portion extending through the support sleeve between the piling and the support sleeve.

31. The system of claim 30 further comprising an additional support sleeve extending in a spaced relation to the first-mentioned support sleeve, the guide sleeve and the piling extending through both of the support sleeves.

32. The system of claim 28 further comprising an additional support sleeve extending in a spaced relation to the first-mentioned support sleeve.

33. The system of claim 32 further comprising an additional mounting unit for mounting the additional support sleeve to the foundation or slab, the additional mounting unit comprising a mounting arm connected to the additional support sleeve and a mounting plate connected to the latter mounting arm and adapted to be bolted to the foundation or slab.

34. The system of claim 28 wherein the ram assembly is normally in an expanded position and retracts to drive the piling and comprises two ram units extending on opposite sides of the piling.

35. The system of claim 34 further comprising two attachment plates extending on opposite sides of the support sleeve for respectively receiving the ram units.

36. The system of claim 34 wherein the clamping assembly comprises a clamping member extending around the upper portion of the piling, and two plates extending on opposite sides of the clamping member for respectively receiving the ram units.

37. The system of claim 36 wherein the clamping member is adapted to clamp the piling upon downward movement relative thereto and to disengage the piling upon upward movement relative thereto.

38. The system of claim 28 further comprising at least one rod extending upwardly from the support sleeve and wherein the securing means comprises a nut in threaded engagement with the at least one rod.

39. The system of claim 38 wherein the clamping assembly further comprises at least one plate slidably mounted relative to the at least one rod and connected to the piling for movement therewith.

40. A system for raising and supporting the foundation or slab of a building, said system comprising two spaced support sleeves, a guide sleeve having a lower portion extending into the ground and an upper portion extending through the support sleeves for receiving a piling, two mounting units for respectively mounting the support sleeves to the foundation or slab, a clamping assembly for engaging the upper portion of the piling, a ram assembly connected between the clamping assembly and the support sleeve for initially applying a load to the piling to drive the piling into the ground until the piling encounters a predetermined resistance, and then applying an additional load to the piling to raise the support sleeve and the foundation or slab a predetermined distance relative to the piling, and means for securing the support sleeve in the raised position relative to the piling to secure the foundation in its raised position.

41. The system of claim 40 wherein the piling comprises a plurality of pipe segments and wherein the plate extends between two adjacent segments.

42. The system of claim 40 wherein the support sleeves are vertically spaced and wherein the piling has an upper portion extending above the upper support sleeve and a lower portion extending below the lower support sleeve and into the ground.

43. The system of claim 40 wherein each mounting unit comprises a mounting arm extending from its respective support sleeve and at least one mounting plate connected to the mounting arm and adapted to be bolted to the foundation or slab.

44. The system of claim 40 further comprising an additional mounting unit for mounting the additional support sleeve to the foundation or slab, the mounting unit comprising a mounting arm connected to the additional support sleeve and a mounting plate connected to the mounting arm and adapted to be bolted to the foundation or slab.

45. The system of claim 40 wherein the ram assembly is normally in an expanded position and retracts to drive the piling and comprises two ram units extending on opposite sides of the piling.

46. The system of claim 45 further comprising two attachment plates extending on opposite sides of each support sleeve for respectively receiving the ram units.

47. The system of claim 45 wherein the clamping assembly comprises a clamping member extending around the upper portion of the piling, and two plates extending on opposite sides of the clamping member for respectively receiving the ram units.

48. The system of claim 47 wherein the clamping member is adapted to clamp the piling upon downward movement relative thereto and to disengage the piling upon upward movement relative thereto.

49. The system of claim 40 further comprising at least one rod extending upwardly from the support sleeve and a nut in threaded engagement with the at least one rod.

50. The system of claim 49 wherein the clamping assembly further comprises at least one plate slidably mounted relative to the at least one rod and connected to the piling for movement therewith.

51. The system of claim 49 wherein the piling comprises a plurality of pipe segments and wherein the plate extends between two adjacent segments.

52. A system for raising and supporting the foundation or slab of a building, said system comprising two spaced support sleeves which receive a piling, two mounting units for respectively mounting the support sleeves to the foundation or slab, a clamping assembly for engaging the upper portion of the piling, a ram assembly connected between the clamping assembly and the support sleeve for initially applying a load to the piling to drive the piling into the ground until the piling encounters a predetermined resistance, and then applying an additional load to the piling to raise the support sleeve and the foundation or slab a predetermined distance relative to the piling, and means for securing the support sleeve in the raised position relative to the piling to secure the foundation in its raised position.

53. The system of claim 52 wherein the support sleeves are vertically spaced and wherein the piling has an upper portion extending above the upper support sleeve and a lower portion extending below the lower sleeve and into the ground.

54. The system of claim 52 wherein each mounting unit comprises a mounting arm extending from its respective support sleeve and at least one mounting plate connected to the mounting arm and adapted to be bolted to the foundation or slab.

55. The system of claim 52 further comprising a guide sleeve having a lower portion extending into the ground and an upper portion extending through the support sleeves between the piling and the support sleeves.

56. The system of claim 52 wherein the ram assembly is normally in an expanded position and retracts to drive the piling and comprises two ram units extending on opposite sides of the piling.

57. The system of claim 56 further comprising two attachment plates extending on opposite sides of one of the support sleeves for respectively receiving the ram units.

58. The system of claim 56 wherein the clamping assembly comprises a clamping member extending around the upper portion of the piling, and two plates extending on opposite sides of the clamping member for respectively receiving the ram units.

59. The system of claim 58 wherein the clamping member is adapted to clamp the piling upon downward movement relative thereto and to disengage the piling upward movement relative thereto.

60. The system of claim 52 further composing at least one rod extending upwardly from the support sleeve and a nut in threaded engagement with the at least one rod.

61. The system of claim 60 wherein the clamping assembly further composes at least one plate slidably mounted relative to the at least one rod and connected to the piling for movement therewith.

62. The system of claim 61 wherein the piling composes a plurality of pipe segments and wherein the plate extends between two adjacent segments.

63. A system for raising and supporting the foundation or slab of a building; said system comprising a support sleeve which receives a piling; a mounting unit for mounting the support sleeve to the foundation or slab and comprising a mounting arm extending from the support sleeve, and at least one mounting plate connected to the mounting arm and adapted to be bolted to the foundation or slab; a clamping assembly for engaging the upper portion of the piling; a ram assembly connected between the clamping assembly and the support sleeve for initially applying a load to the piling to drive the piling into the ground until the piling encounters a predetermined resistance, and then applying an additional load to the piling to raise the support sleeve and the foundation or slab a predetermined distance relative to the piling; and means for securing the support sleeve in the raised position relative to the piling to secure the foundation in its raised position, the securing means comprising at least one rod extending upwardly from the support sleeve, and a plate slidably mounted relative to the at least one rod and connected to the piling for movement therewith.

64. A system for raising and supporting the foundation or slab of a building; said system comprising two support sleeves which receive a piling; a guide sleeve having a lower portion extending into the ground and an upper portion extending through the support sleeves between the piling and the support sleeves; two mounting units for respectively mounting the support sleeves to the foundation or slab, each mounting unit comprising a mounting arm connected to its corresponding support sleeve, and a mounting plate connected to the latter mounting arm and adapted to be bolted to the foundation or slab; a clamping assembly for engaging the upper portion of the piling; a ram assembly connected between the clamping assembly and one of the support sleeves for initially applying a load to the piling to drive the piling into the ground until the piling encounters a predetermined resistance, and then applying an additional load to the piling to raise the one support sleeve and the foundation or slab a predetermined distance relative to the piling; and means for securing the one support sleeve in the raised position relative to the piling to secure the foundation in its raised position, the securing means comprising at least one rod extending upwardly from the one support sleeve, and a plate slidably mounted relative to the at least one rod and connected to the piling for movement therewith.

65. The system of claim 64 wherein the piling has an upper portion extending above the support sleeve and a lower portion extending below the support sleeve and into the ground.

66. The system of claim 64 further comprising a guide sleeve having a lower portion extending into the ground and an upper portion extending through the support sleeve between the piling and the support sleeve.

67. The system of claim 66 further comprising an additional support sleeve extending in a spaced relation to the first-mentioned support sleeve, the guide sleeve and the piling extending through both of the support sleeves.

68. The system of claim 64 wherein the ram assembly is normally in an expanded position and retracts to drive the piling and comprises two ram units extending on opposite sides of the piling.

69. The system of claim 68 further comprising two attachment plates extending on opposite sides of the support sleeve for respectively receiving the ram units.

70. The system of claim 69 wherein the clamping assembly comprises a clamping member extending around the upper portion of the piling, and two plates extending on opposite sides of the clamping member for respectively receiving the ram units.

71. The system of claim 70 wherein the clamping member is adapted to clamp the piling upon downward movement relative thereto and to disengage the piling upon upward movement relative thereto.

72. The system of claim 64 wherein there are two rods extending to each side of the support sleeve and wherein the securing means further comprises a pair of nuts in threaded engagement with the rods.

73. The system of claim 64 wherein the piling comprises a plurality of pipe segments and wherein the plate extends between two adjacent segments.

74. A system for raising and supporting the foundation or slab of a building, said system comprising a support sleeve which receives a piling, means for bolting the support sleeve to the foundation or slab, a clamping assembly for engaging the upper portion of the piling, a ram assembly connected between the clamping assembly and the support sleeve for initially applying a load to the piling to drive the piling into the ground until the piling encounters a predetermined resistance, and then applying an additional load to the piling to raise the support sleeve and the foundation or slab a predetermined distance relative to the piling, and means for securing the support sleeve in the raised position relative to the piling to secure the foundation in its raised position.

75. The system of claim 74 wherein the means comprises an arm extending from the support sleeve and a mounting plate connected to the arm and having at least one opening formed therethrough for receiving a fastener.

* * * * *

UNITED STATES PATENT AND TRADEMARK OFFICE

CERTIFICATE OF CORRECTION

PATENT NO. : 5,722,798

DATED : March 3, 1998

INVENTOR(S) : Steven D. Gregory

It is certified that error appears in the above-identified patent and that said Letters Patent is hereby corrected as shown below:

Col. 3, line 10, "devises" should be --clevices--

Col. 3, line 12, "devises" should be --clevices--

Col. 3, line 15, "devises" should be --clevices--

Claim 60, line 1, "composing" should be --comprising--

Claim 61, line 2, "composes" should be --comprises

Claim 62, line 1, "composes" should be --comprises

Signed and Sealed this

Twenty-fourth Day of November,1998

Bruce Lehman

*Attest:*

BRUCE LEHMAN

*Commissioner of Patents and Trademarks*

*Attesting Officer*